US006671895B2

(12) United States Patent
Lewis

(10) Patent No.: US 6,671,895 B2
(45) Date of Patent: Jan. 6, 2004

(54) DUAL PURPOSE BEADING FOR SWIMMING POOL LINERS

(75) Inventor: Craig Lewis, Ballston Lake, NY (US)

(73) Assignee: Latham Plastics, Inc., Scotia, NY (US)

( * ) Notice: Subject to any disclaimer, the term of this patent is extended or adjusted under 35 U.S.C. 154(b) by 0 days.

(21) Appl. No.: 10/146,746

(22) Filed: May 16, 2002

(65) Prior Publication Data

US 2002/0170109 A1 Nov. 21, 2002

Related U.S. Application Data

(60) Provisional application No. 60/291,998, filed on May 18, 2001.

(51) Int. Cl.[7] ..... E04H 4/00
(52) U.S. Cl. ..... 4/506; 4/498; 4/503
(58) Field of Search ..... 4/506, 496, 498, 4/501, 503–504, 513; 52/169.7

(56) References Cited

U.S. PATENT DOCUMENTS 3,975,782 A * 8/1976 Lankheet ..... 52/169.7
4,064,571 A * 12/1977 Phipps ..... 52/716.2
4,429,425 A * 2/1984 Weir et al. ..... 4/503
4,980,934 A * 1/1991 Dahowski et al. ..... 4/496
5,107,551 A * 4/1992 Weir et al. ..... 4/496
5,134,819 A * 8/1992 Boyack ..... 52/169.7
5,282,282 A * 2/1994 Shehan et al. ..... 4/503
5,720,056 A * 2/1998 Aymes ..... 4/488
6,209,151 B1 * 4/2001 Schwimmer ..... 4/506

FOREIGN PATENT DOCUMENTS

FR 2800115 * 10/1999 ..... E04H/4/04
WO WO 00/43614 * 7/2000

* cited by examiner

*Primary Examiner*—Gregory Huson
*Assistant Examiner*—Amanda Flynn
(74) *Attorney, Agent, or Firm*—Steinberg & Raskin, P.C.

(57) ABSTRACT

The present invention relates to a dual purpose beading for swimming pool liners. The beading includes a first portion structured and arranged for attachment of a swimming pool liner thereto and a second hook shaped portion. The hooked shaped portion is adapted so that it is moveable from a first position that enables the beading to be placed over an upper edge of a pool wall and a second position that enables the beading to be inserted into a receptor type coupling in a pool wall.

10 Claims, 6 Drawing Sheets

DUAL PURPOSE BEADING FOR SWIMMING POOL LINERS

This application claims the benefit of provisional application 60/291,998 filed on May 18, 2001.

FIELD OF THE INVENTION

The present invention is directed generally to a border or beading for use in attachment of an article to another article or surface. In particular, the present invention is directed to a border or beading for use in attachment of a swimming pool liner to an upper edge of a swimming pool wall. The present invention also provides a swimming pool liner with a dual purpose beading circumferentially connected thereto for attachment to a swimming pool wall.

BRIEF DESCRIPTION OF THE DRAWING

For a better understanding of the invention, reference is made to the drawings incorporated herein by reference and in which.

DETAILED DESCRIPTION OF THE INVENTION

Illustrative embodiments of the present invention described below are directed to a border or beading for use in attachment of a swimming pool liner to a swimming pool wall. The beading comprises an elongated member with a first portion constructed and configured for attachment of a swimming pool liner thereto, and a second hook-shaped portion constructed and configured to couple the beading to an upper edge of a swimming pool wall. The beading enables the liner to be joined to the swimming pool wall to provide for installation of the liner. Those skilled in the art will appreciate that the border or beading of the present invention may be used in other types of installations, wherein an article requires joining with another article or surface.

Embodiments are described herein with reference to FIGS. 1–6 which are presented for the purpose of illustrating embodiments and are not intended to limit the scope of the invention.

Figure 1:
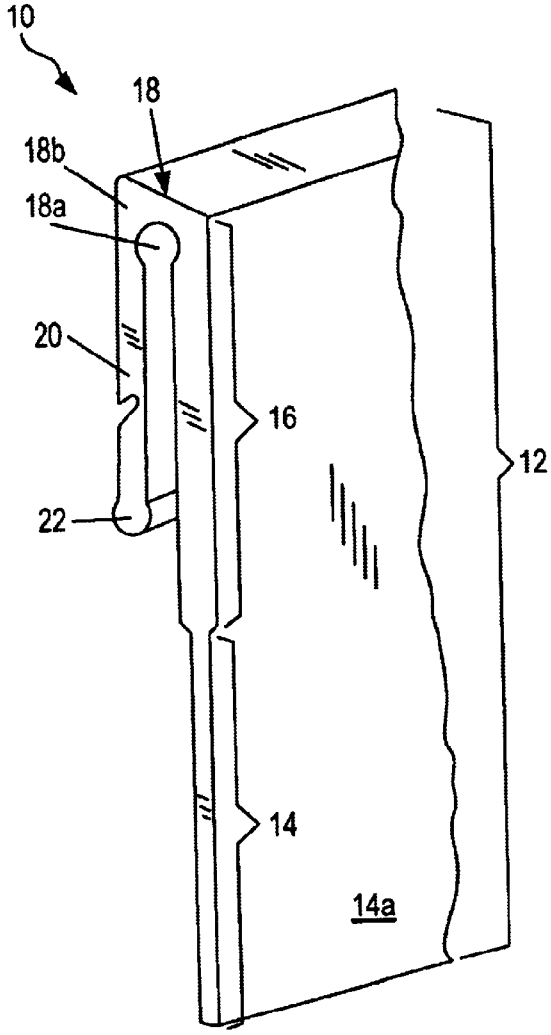
FIG. 1 is a perspective view of a first embodiment of a beading according to the invention.
Figure 2:
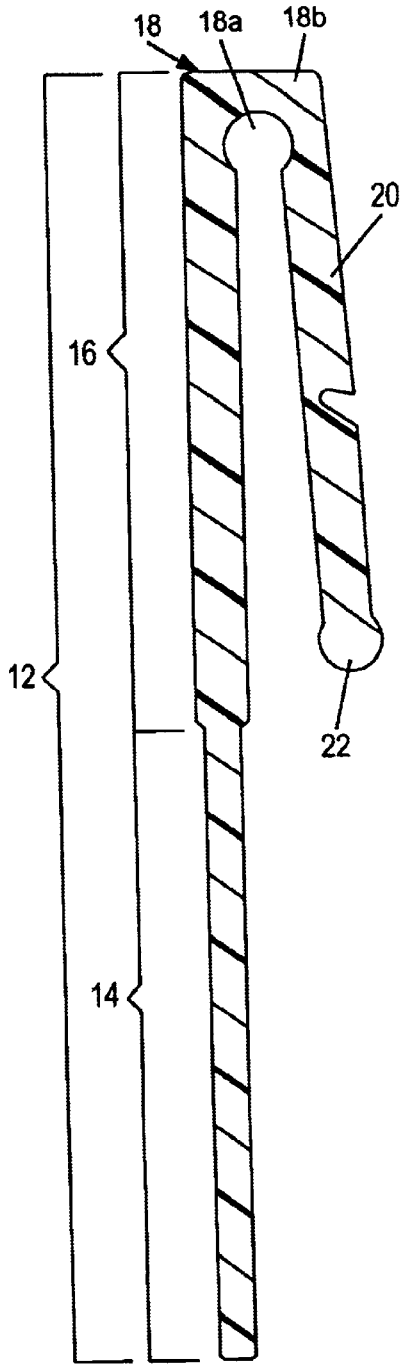
FIG. 2 is a cross-sectional view of the first embodiment.

Referring to FIG. 1, a perspective of a first embodiment of the invention illustrates a beading 10 comprising an elongated member 12 including a first portion 14 constructed and configured to receive a swimming pool liner, wherein the first portion 14 includes a substantially planar surface 14*a* to which the swimming pool liner is adhered or annealed thereto. The elongated member 12 further comprises a second hook-shaped portion 16 constructed and configured to define a seating groove 18 to couple the beading 10 to a swimming pool wall. Referring to FIGS. 1–2, the seating groove 18 is constructed and configured as a substantially inverted U-shaped end 18*b* which defines an internal groove 18*a*. An outer flange 20 extends from the seating groove 18 adjacent to the elongated member 12 and terminates into a terminal bead 22.

Figure 3A:
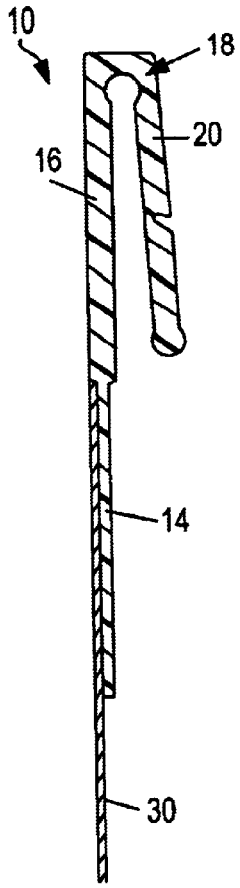
FIG. 3A is a cross-sectional view of the beading of the first embodiment with a swimming pool wall liner attached thereto.

Referring to FIGS. 3A–3E, cross-sectional views of the first embodiment illustrate the seating groove 18 and the outer flange 20 of the beading 10 that serve to seat the beading 10 to an upper perimeter edge 34 of a swimming pool wall 32 in order to mount the beading 10 to the swimming pool wall. As shown in FIG. 3A, a swimming pool liner 30 is attached to a surface 14*a* of the first portion 14 of the elongated member 12.

Figure 3C:
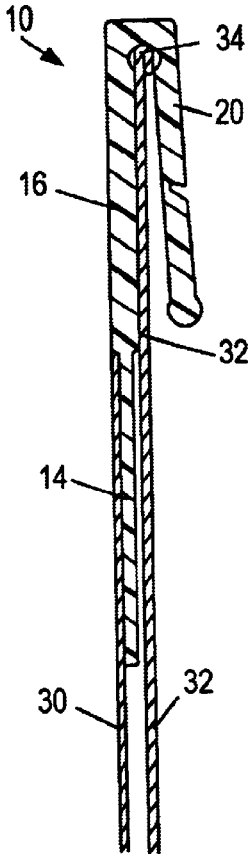
FIG. 3C is a cross-sectional view of the beading of the first embodiment seated upon the overlap-type swimming pool wall.
Figure 3D:
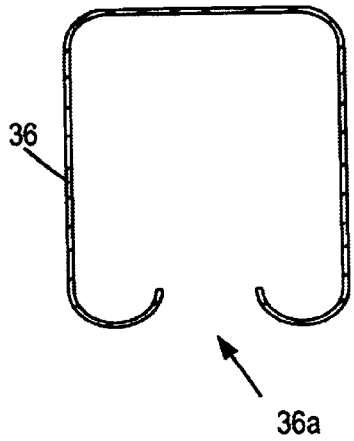
FIG. 3D is a cross-sectional view of a pool rail.

The beading 10 is joined to the swimming pool wall 32 by positioning the seating groove 18 on the upper perimeter edge 34 of the pool wall 32. The beading 10 conforms to the upper perimeter edge 34 of the swimming pool wall 32, such as the overlap-type of swimming pool wall shown in FIG. 3B. As shown in FIG. 3C, the internal groove 18*a* is constructed and configured such that it receives and closely couples with the upper perimeter edge 34 of the pool wall 32. In one embodiment, the beading may further comprise a pool rail 36, such as the pool rail shown in FIG. 3D, including a hollow, elongated member with an opening 36*a* to permit mounting of the pool rail 36 upon the seating groove 18 of the beading 10. As shown in FIG. 3E, the pool rail 36 attaches to the seating groove 18 of the beading 10, thereby securely mounting the beading 10 to the upper perimeter edge 34 and joining the wall liner 30 with the swimming pool wall 32.

Figure 3B:
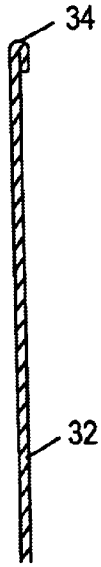
FIG. 3B is a cross-sectional view of an upper perimeter edge of an overlap-type swimming pool wall.
Figure 3E:
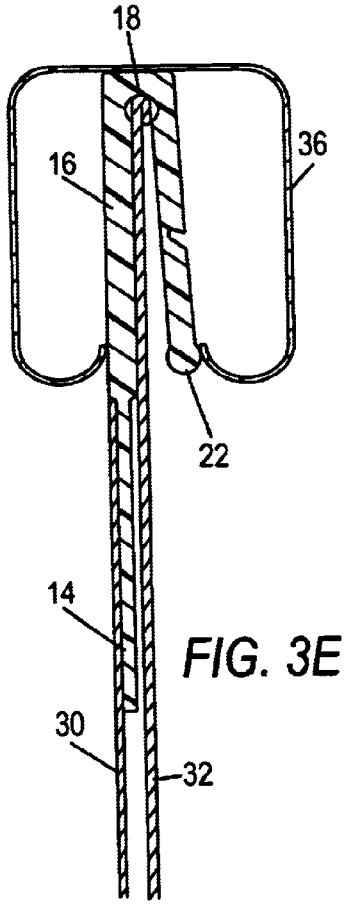
FIG. 3E is a cross sectional view of the pool rail mounted on the beading.

The beading 10 of the first embodiment is used with swimming pools that are referred to as an overlap-type swimming pool, as shown in FIG. 3B, which denotes the construction and configuration of the swimming pool wall and the nature of coupling of the beading 10 to the wall. As shown in FIG. 3B, the first embodiment of the beading 10 according to the invention "overlaps" the upper perimeter edge 34 of the swimming pool wall 32 to mount the beading 10 thereto.

The beading 10 is constructed of a durable, flexible material suitable for use with a swimming pool, such as, although not limited to, extruded plastics, polyvinylchloride, nylon, polyurethane, and neoprene. Those of ordinary skill in the art may select other materials to accommodate the particular configuration and dimensions of a swimming pool wall liner and swimming pool wall. The beading is manufactured generally by an extrusion process, wherein the beading is formed as a single unit.

Figure 6:
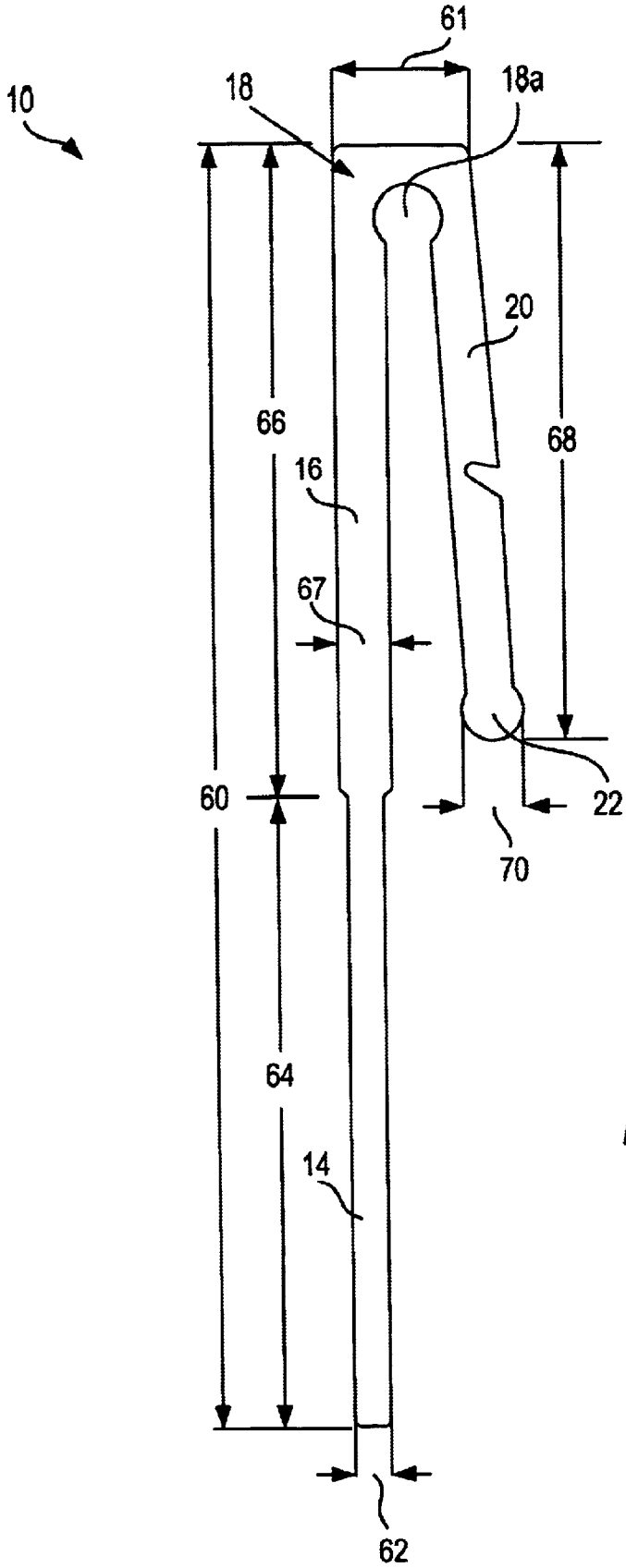
FIG. 6 is a dimensional view of the beading according to the invention.

Referring to FIG. 6, the dimensions of the beading 10 according to the first and second embodiments of the invention are illustrated. The beading 10 is particularly suited for, although not limited to, use with above-ground swimming pools. In one embodiment, the beading 10 can have any size, dimensions, thickness and circumference to accommodate the use, size, dimensions, and circumference of a swimming pool liner and a swimming pool. Thus, it is understood by those of ordinary skill in the art that the dimensions of the beading 10 shown in FIG. 6 are illustrative of the embodiments described herein, and the beading 10 according to the invention is not limited to those dimensions disclosed in FIG. 6 but may include different dimensions as noted above.

As shown in FIG. 6, the elongated member 12 of the beading 10 is generally from about 1 inch to about 3 inches in overall height 60. The first portion 14 is generally from about 0.5 inches to about 1.5 inches in height 64 and from about 0.03 inches to about 0.05 inches in thickness 62. The second hook-shaped portion 16 is generally from about 0.5 inches to about 1.5 inches in height 66 with a thickness 67 of from about 0.050 inches to about 0.150 inches. At the seating groove 18, the beading 10 has a thickness 61 of from about 0.14 inches to about 0.38 inches. The internal groove 18*a* has a radius of from about 0.038 inches to about 0.042 inches, and the terminal bead 22 has a radius of from about 0.034 inches to about 0.042 inches. The outer flange 20 is generally from about 0.50 inches to about 0.75 inches in height 68. The outer flange 22 has a thickness 70 of from about 0.050 inches to about 0.200 inches.

Figure 4A:
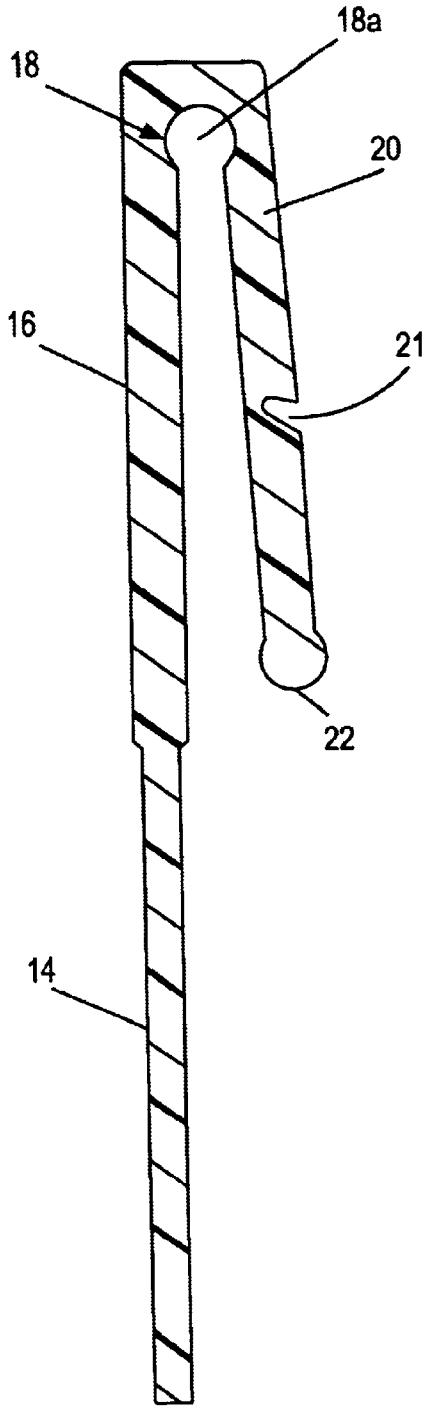
FIG. 4A is a cross-sectional view of a second embodiment of a beading according to the invention.
Figure 4B:
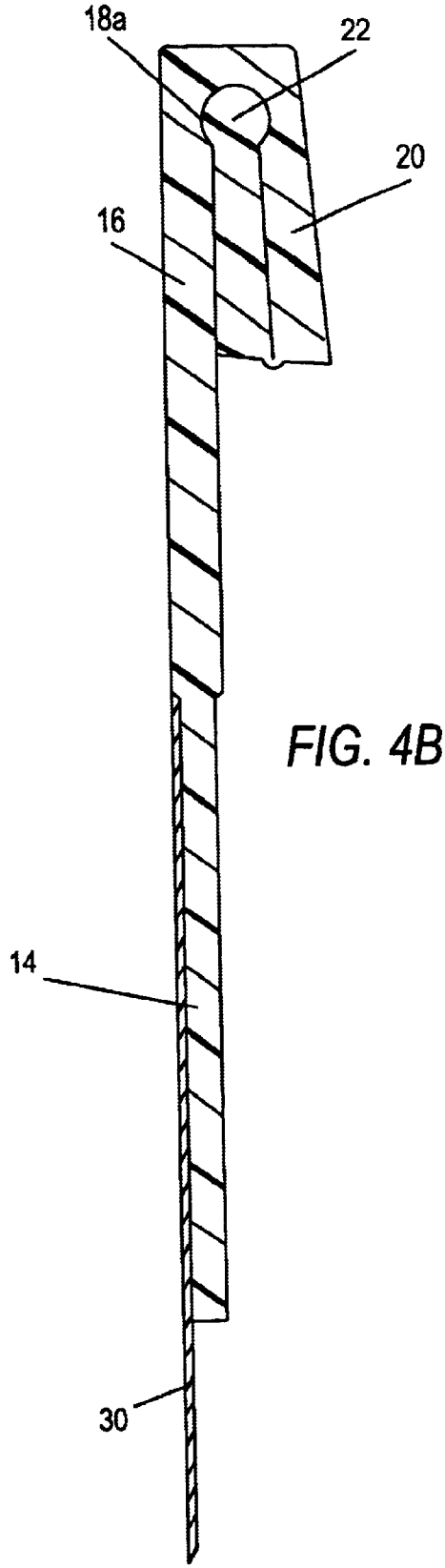
FIG. 4B is a cross-sectional view of the second embodiment with an outer flange folded under.

Referring to FIGS. 4A–4B, cross-sectional views illustrate a second embodiment of a beading 10 according to the invention wherein the beading 10 further comprises the outer flange 20 with a notched groove 21. The notched groove 21 permits the terminal bead 22 of the outer flange 20 to be folded under and into the internal groove 18*a* of the seating groove 18. The terminal bead 22 is constructed and configured such that when it is folded under and received by the internal groove 18*a*, the bead 22 couples closely with the dimensions of the internal groove 18*a*. As shown in FIG. 4A, the terminal bead 22 is circular-shaped and similar in shape and configuration as the internal groove 18*a* in order to permit close coupling of the bead 22 with the internal groove 18*a* when the outer flange 20 is folded under and into the internal groove 18*a*. The shape and configuration of the internal groove 18*a* and terminal bead 22 are not relevant to the invention and may include other shapes and configurations and limited only to the extent the internal groove 18*a* and the terminal bead 22 must be similar in shape and configuration to permit close coupling when the outer flange 22 is folded under and into the internal groove 18*a*. As shown in FIG. 6, in this embodiment the notched groove 21 is angled in a range of, although not limited to, from about 55 degrees to about 77 degrees in relation to an outer surface of the outer flange 22.

Figure 5A:
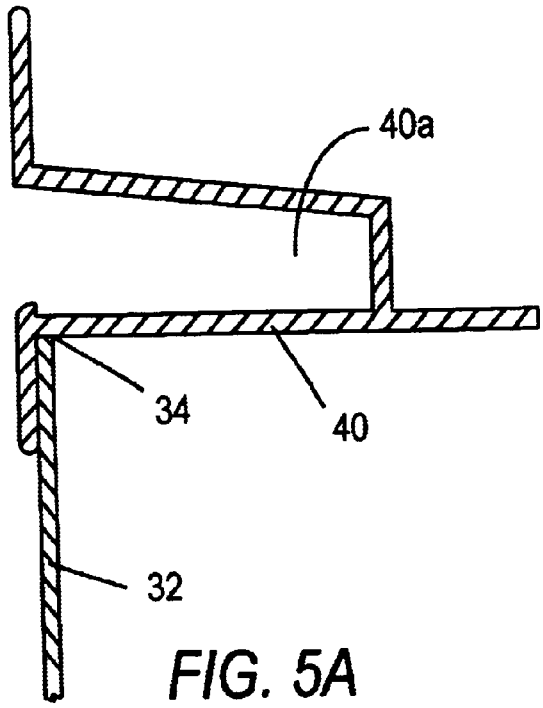
FIG. 5A is a cross-sectional view of an upper perimeter edge of a receptor-type swimming pool wall.
Figure 5B:
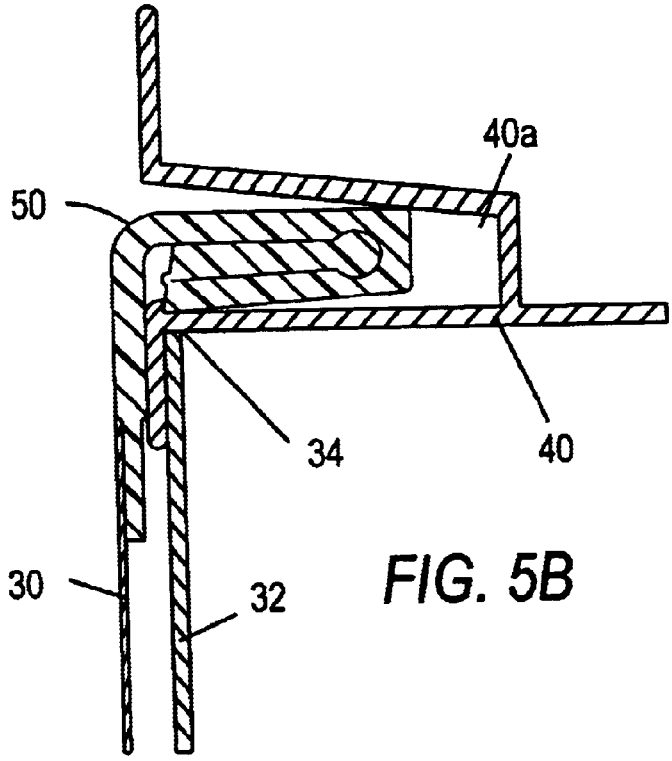
FIG. 5B is a cross-sectional view of the beading of the second embodiment mounted to the receptor-type swimming pool wall.

Referring to FIGS. 5A–5B, the beading 10 of the second embodiment couples with a swimming pool wall with a receptor-type coupling mechanism 40, which is attached to the upper perimeter edge 34 of the swimming pool wall 32. As shown in FIG. 5A, the receptor-type coupling mechanism 40 includes an insertion track 40*a* that is similar in shape and configuration as a folded portion of the beading 10 formed when the outer flange 22 is folded under and into the internal groove 18*a* of the seating groove 18. As shown in FIG. 5B, the beading 10, with the swimming pool liner 30 attached thereto, is inserted into and received by the insertion track 40*a* to mount the beading 10 to the upper perimeter edge 34 of the swimming pool wall 32, thereby joining the liner 30 with the swimming pool wall 32.

The beading 10 of the second embodiment is used with swimming pools that are referred to as receptor-type swimming pools, which denotes the construction and configuration of the swimming pool wall and the nature of coupling of the beading 51 to the upper perimeter edge 34 of the swimming pool wall 32. As shown in FIG. 5B, the beading 10 of the second embodiment of the invention is inserted into a "receptor" type of swimming pool wall 32 to mount the beading 10 thereto.

A feature and advantage of the embodiments of the beading according to the invention is that the construction and configuration of the beading is such that the beading is used with both the overlap- and receptor-type of swimming pools, thereby requiring manufacture of only one type of beading. With a single construction and configuration, the beading of the invention maintains the same height of the swimming pool wall for both overlap and receptor types of swimming pools, thereby requiring the manufacture of only one type of swimming pool liner. Thus, the beading of the present invention provides manufacturing efficiency and installation flexibility with respect to swimming pool wall liners.

Figure 7:
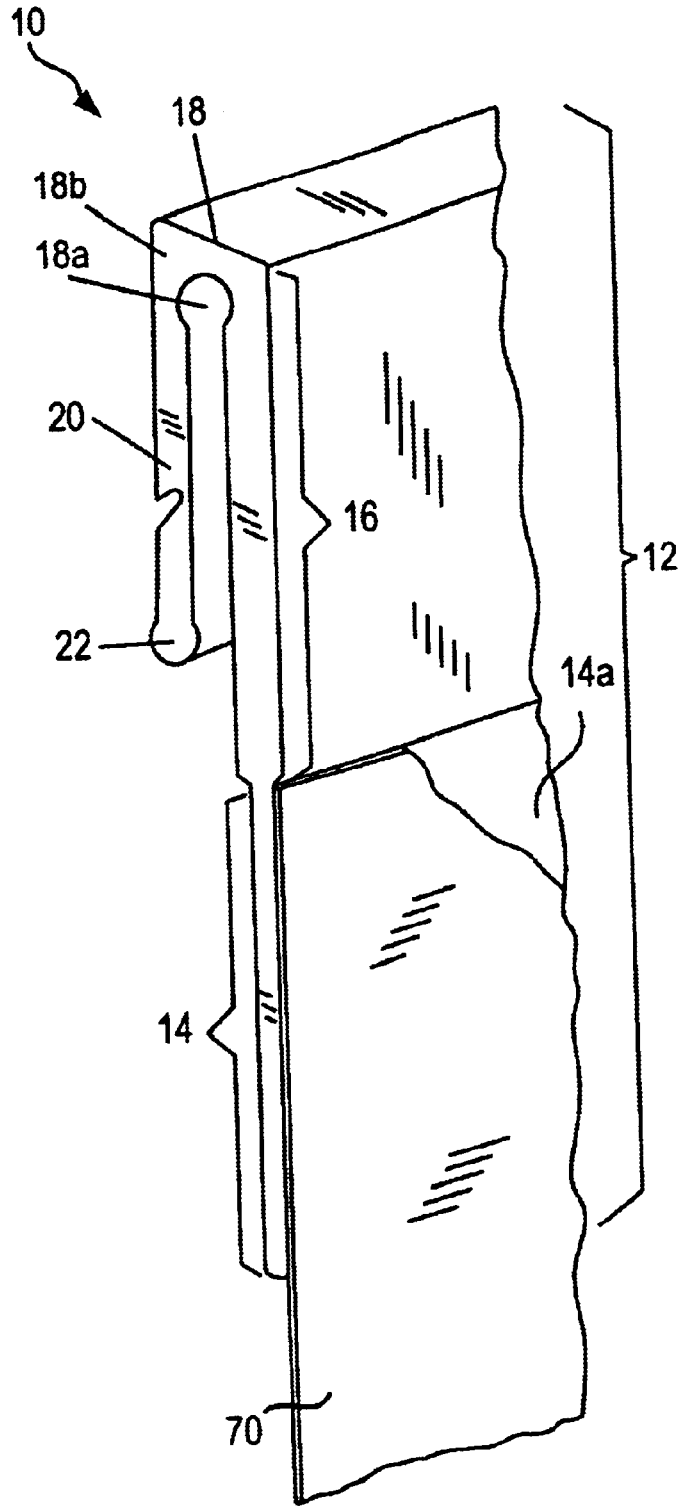
FIG. 7 is a perspective view of a third embodiment of a swimming pool liner with the beading according to the invention attached thereto.

Referring to FIG. 7, a third embodiment of the invention is illustrated including a swimming pool liner 70 comprising the beading 10 according to the invention, wherein the swimming pool liner 70 is attached to the planar surface 14*a* of the first portion 14 of the beading 10. The swimming pool wall liner 70 is constructed of a strong and flexible material suitable for use with swimming pools such as, although not limited to, flexible polyvinyl chloride sheet. The liner 70 is permanently adhered, bonded or annealed to the planar surface 14*a* of the first portion 14 by any one of a number of methods or mechanisms well known in the art for adhering, bonding or annealing such materials, including, although not limited to, RF sealing, heat sealing, impulse welding, solvent bonding, and ultrasonically welding. The swimming pool liner 70 with the beading attached thereto according to the invention may be used with either the overlap- or receptor-type of swimming pool wall configurations to join the liner 70 to the wall 32 of the swimming pool. As noted above, a feature and benefit of the swimming pool liner and beading according to the invention is that such combination permits the swimming pool liner 70 to be manufactured in particular sizes with specific dimensions to accommodate the dimensions of swimming pools of various sizes.

Having thus described at least one illustrative embodiment of the invention, various alterations, modifications and improvements will readily occur to those skilled in the art. Such alterations, modifications and improvements are intended to be within the scope and spirit of the invention. Accordingly, the foregoing description is by way of example only and is not intended as limiting. The invention's limit is defined only in the following claims and the equivalents thereto.

I claim:

1. A dual purpose beading for pool liners comprising:

an elongated member including a first portion for coupling a pool liner to said beading and a second hook shaped portion, wherein said hooked shaped portion is movable from a first position that enables said beading to be placed over an upper edge of a pool wall to a second position that enables said beading to be inserted into a receptor type coupling in a pool wall;

wherein said hooked shaped portion includes an end portion having an internal groove arranged in said end portion and an outer flange which extends from said end portion; and wherein said outer flange terminates in a terminal bead structured and arranged to be received and retained in said internal groove of said end portion, said outer flange being movable to enable the selective insertion of said terminal bead into said internal groove to thereby place said hooked shaped portion in said second position.

2. The dual purpose beading according to claim 1, wherein said outer flange has a notched groove therein which defines first and second sections of said outer flange and enables said second section to move hingedly with respect to said first section.

3. The dual purpose bead according to claim 2, wherein said second section terminates in said terminal bead.

4. A pool liner system for swimming pools comprising:

a pool liner;

a beading including an elongated member having a first portion for coupling said pool liner to said beading and a second hook shaped portion, wherein said hooked shaped portion is movable from a first position that enables said beading to be placed over an upper edge of a pool wall to a second position that enables said beading to be inserted into a receptor type coupling in a pool wall wherein said hook shaped portion includes an end portion having an internal groove arranged in said end portion and an outer flange which extends from said end portion;

wherein said outer flange terminates in a terminal bead structured and arranged to be received and retained in said internal groove of said end portion, said outer flange being movable to enable the selective insertion of said terminal bead into said internal groove to thereby place said hooked shaped portion in said second position.

5. The pool liner system according to claim 4, wherein said outer flange has a notched groove therein which defines first and second sections of said outer flange and enables said second section to move hingedly with respect to said first section.

6. The pool liner system according to claim 5, wherein said second section terminates in said terminal bead.

7. The pool liner system according to claim 4, wherein said cool liner is permanently adhered to said first portion.

8. A pool liner system for swimming pools comprising:

a beading including an elongated member having a first portion for coupling said pool liner to said beading and a second hook shaped portion, wherein said hooked shaped portion is movable from a first position that enables said beading to be placed over an upper edge of a pool wall to a second position that enables said beading to be inserted into a receptor type coupling in a pool wall;

a pool rail having a hollow elongated groove structured and arranged to receive said beading;

wherein said hooked shaped portion includes an end portion having an internal groove arranged in said end portion and an outer flange which extends from said end portion; and wherein said outer flange terminates in an a terminal bead structured and arranged to be received and retained in said internal groove of said end portion, said outer flange being movable to enable the selective insertion of said terminal bead into said internal groove to thereby place said hooked shaped portion in said second position.

9. The dual purpose beading according to claim 8, wherein said outer flange has a notched groove therein which defines first and second sections of said outer flange and enables said second section to move hingedly with respect to said first section.

10. The dual purpose bead according to claim 9, wherein said second section terminates in said terminal bead.

* * * * *